US006679948B2

(12) United States Patent
Mead

(10) Patent No.: US 6,679,948 B2
(45) Date of Patent: Jan. 20, 2004

(54) DUST PAN

(76) Inventor: Raymond Mead, 11011 Haradon Rd., Corning, NY (US) 14830

( * ) Notice: Subject to any disclaimer, the term of this patent is extended or adjusted under 35 U.S.C. 154(b) by 148 days.

(21) Appl. No.: 10/054,842

(22) Filed: Jan. 23, 2002

(65) Prior Publication Data

US 2002/0104551 A1 Aug. 8, 2002

Related U.S. Application Data

(60) Provisional application No. 60/266,520, filed on Feb. 5, 2001.

(51) Int. Cl.[7] ..... A47L 13/52

(52) U.S. Cl. ..... 134/6; 15/257.3; 15/257.6; 15/257.7; 15/257.9; 141/108; 294/55; D32/74

(58) Field of Search ..... 15/257.1–257.9; 141/10, 114, 108, 109, 313, 314; 294/55; D32/74; 134/6

(56) References Cited

U.S. PATENT DOCUMENTS

| | | | | |
|---|---|---|---|---|
| 371,612 A | | 10/1887 | McDougal | 15/257.7 |
| 452,696 A | | 5/1891 | Downing | 15/257.1 |
| 768,871 A | | 8/1904 | Alberson | 15/257.3 |
| 1,053,438 A | | 2/1913 | Resch | 15/257.3 |
| 1,167,782 A | * | 1/1916 | Richards | 141/108 |
| D123,510 S | | 11/1940 | Prentice | D32/74 |
| 4,048,692 A | | 9/1977 | Coffey | 15/257.2 |
| 4,562,611 A | | 1/1986 | Marttinen | 15/257.7 |
| 4,629,233 A | * | 12/1986 | Pfisterer | 294/55 X |
| 4,686,734 A | | 8/1987 | Alexander | 15/257.1 |
| 4,709,440 A | | 12/1987 | Conelly | 15/257.3 |
| 5,031,277 A | | 7/1991 | Coker | 15/257.3 |
| 5,367,737 A | | 11/1994 | Vosbikian et al. | 15/257.2 |
| 5,715,564 A | | 2/1998 | Knouse | 15/257.3 |
| 6,233,780 B1 | | 5/2001 | Mead | 15/257.3 |

FOREIGN PATENT DOCUMENTS

| | | | | |
|---|---|---|---|---|
| FR | 2499841 | | 8/1982 | 294/55 |
| GB | 189994 | | 12/1921 | 15/257.7 |
| GB | 478722 | | 4/1936 | 15/257.3 |
| JP | 9-56655 | * | 3/1997 | |

* cited by examiner

*Primary Examiner*—Mark Spisich
(74) *Attorney, Agent, or Firm*—Hedman & Costigan, P.C.

(57) ABSTRACT

A dust pan for facilitating emptying of debris from the dust pan, that is nestable one within another for decreased shipping costs, and that can be easily and inexpensively manufactured as a single piece.

19 Claims, 4 Drawing Sheets

DUST PAN

CROSS REFERENCE TO PRIORITY APPLICATION

This application claims priority from U.S. Provisional Application Ser. No. 60/266,520 filed on Feb. 5, 2001.

FIELD OF THE PRESENT INVENTION

The present invention relates to an improved dust pan. More particularly, the present invention relates to a dust pan that provides improved means for removing the debris from the dust pan, that has low transport cost due to nestability, and that can be injection molded in a single piece

BACKGROUND OF THE PRESENT INVENTION

Dust pans of numerous shapes and sizes are known in the art. Dust pans are useful for cleaning in and about the home and commercial and industrial buildings. Dust pans typically have a broad shallow container or scoop attached to a handle, the scoop or container being open on one edge. The scoop is rested on the ground and a broom or other implement is used to push dust or other debris over the edge and into the scoop. The scoop is then manipulated like a shovel, to lift and dump the debris into a receptacle out of the same open end through which the debris or dust originally entered. Exemplary dust pan devices of the prior art include Coffey, U.S. Pat. No. 4,048,692; Marttinen, U.S. Pat. No. 4,562,611; Kahan, U.S. Pat. No. 4,686,734; and Vosbikian et al., U.S. Pat. No. 5,367,737.

However, all of the prior art dust pan devices suffer from a common drawback, namely, they have a tendency to spill a portion of the debris upon emptying. It would therefore solve a long felt need in the art if the is drawback were to be overcome and a dust pan provided that was structured to substantially reduce, if not eliminate spillage of debris when the dust pan is emptied.

It would also be desirable to provide a dust pan that is nestable for lower transport costs.

It would be further desirable to provide a dust pan that can be simply and inexpensively manufactured.

Special mention is made of U.S. Pat. No. 6,233,780 by the same inventor.

SUMMARY OF THE INVENTION

The dust pan of the present invention solves the problems of the prior art devices by providing an improved means for emptying out the debris contained in the dust pan. In this regard, the present invention provides a dust pan that is equipped with a rear debris outlet, and wherein the rear edge of the dust pan has a length that is at most about 75% of the length of the front edge of the dust pan.

In this manner, by providing a rear debris outlet and a rear edge shorter than the front edge, the present inventor has found that substantially less debris is spilled when the dust pan is emptied, as opposed to conventional dust pans that are emptied from the front opening.

Additionally, by providing a dust pan in which the debris inlet is constructed such that the height and width of the debris inlet are each greater than the height and width of the debris outlet, the present invention has discovered that the dust pans can be horizontally nested by sliding the debris outlet of one such dust pan into the debris inlet of a second dust pan. Such convenient nestability allows for greatly lower shipping and storage costs.

Additionally, the dust pan of the present invention can be simply and inexpensively manufactured in a single piece.

The dust pan of the present invention can additionally accommodate a collection bag or collection container that may be attached to the dust pan to cover the rear debris outlet. The bag or container may be attached via any means known to those of ordinary skill in the art, for example by snaps, however, attachment by grommets, a retaining bar, a device such as a twist lock feature, or any other attachment means known to those skilled in the art is within the scope of the invention.

Accordingly, the present invention provides a dust pan comprising the following components: (a) a substantially flat bottom panel having a front edge of length x, a back edge of length y, a left side edge and a right side edge; (b) a left side panel connected to the left side edge of the flat bottom panel and having a back edge, a front edge, and a top edge; (c) a right side panel connected to the right side edge of the flat bottom panel and having a back edge, a front edge, and a top edge; the length of said front edges of said left and right side panels being greater than the length of said back edges of said left and right side panels; (d) a substantially rectangular back panel attached to the back edge of the bottom panel and the back edges of the left side panel and right side panel; (e) a substantially flat top panel attached to the top edges of the left and right side panels; wherein the top edges of the left and right side panels are substantially straight and downwardly taper from the front to the back of the dust pan; wherein the back panel has a height less than the height of the back edges of the left and right side panels whereby a rear debris outlet is defined between an upper edge of the back panel and a lower surface of the top panel through which debris collected by the dust pan may be emptied; wherein the top panel has a length less than the length of the left and right side panels to thereby define a debris inlet in the front of the dust pan; and wherein said debris inlet in said front of said dust pan is dimensioned such that said dust pan can be inserted rearwardly into a second dust pan through said debris inlet such that said dust pans are situated in nesting fashion therein, for purposes of decreased transport costs.

DETAILED DESCRIPTION OF THE PRESENT INVENTION

Figure 1:
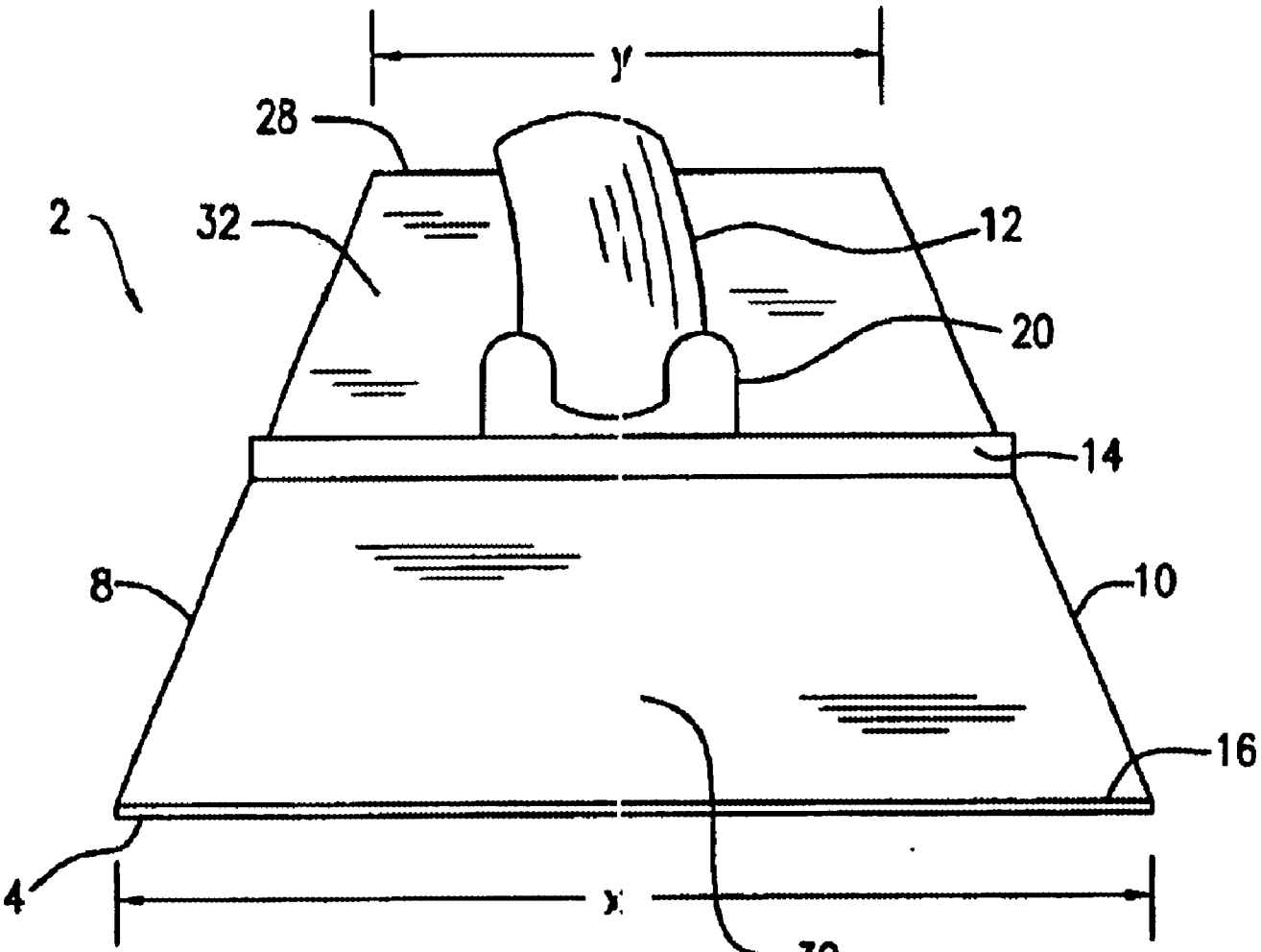
FIG. 1 is a front view of a preferred dust pan of the present invention.
Figure 2:
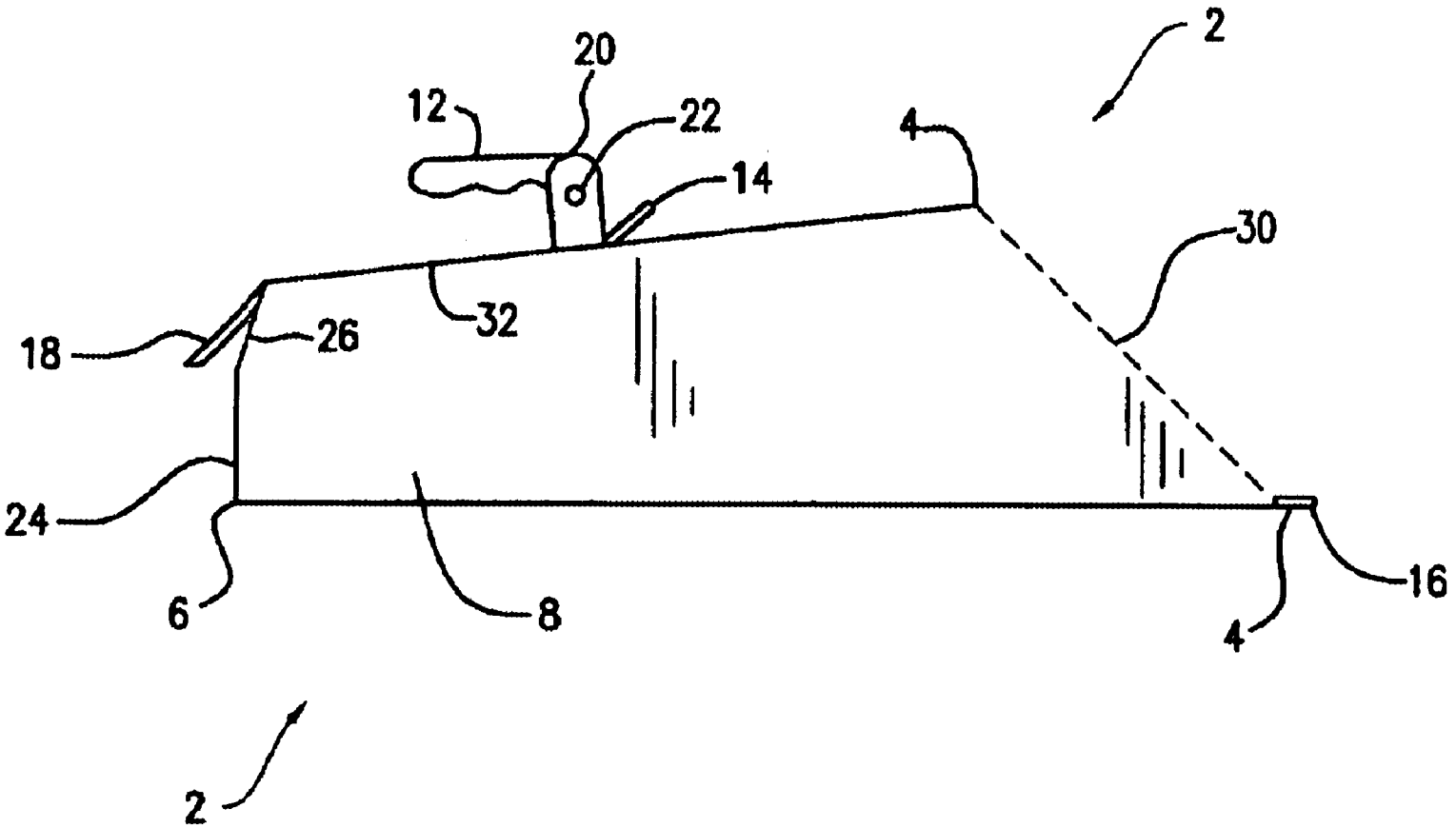
FIG. 2 is a side view of a preferred dust pan of the present invention.
Figure 3:
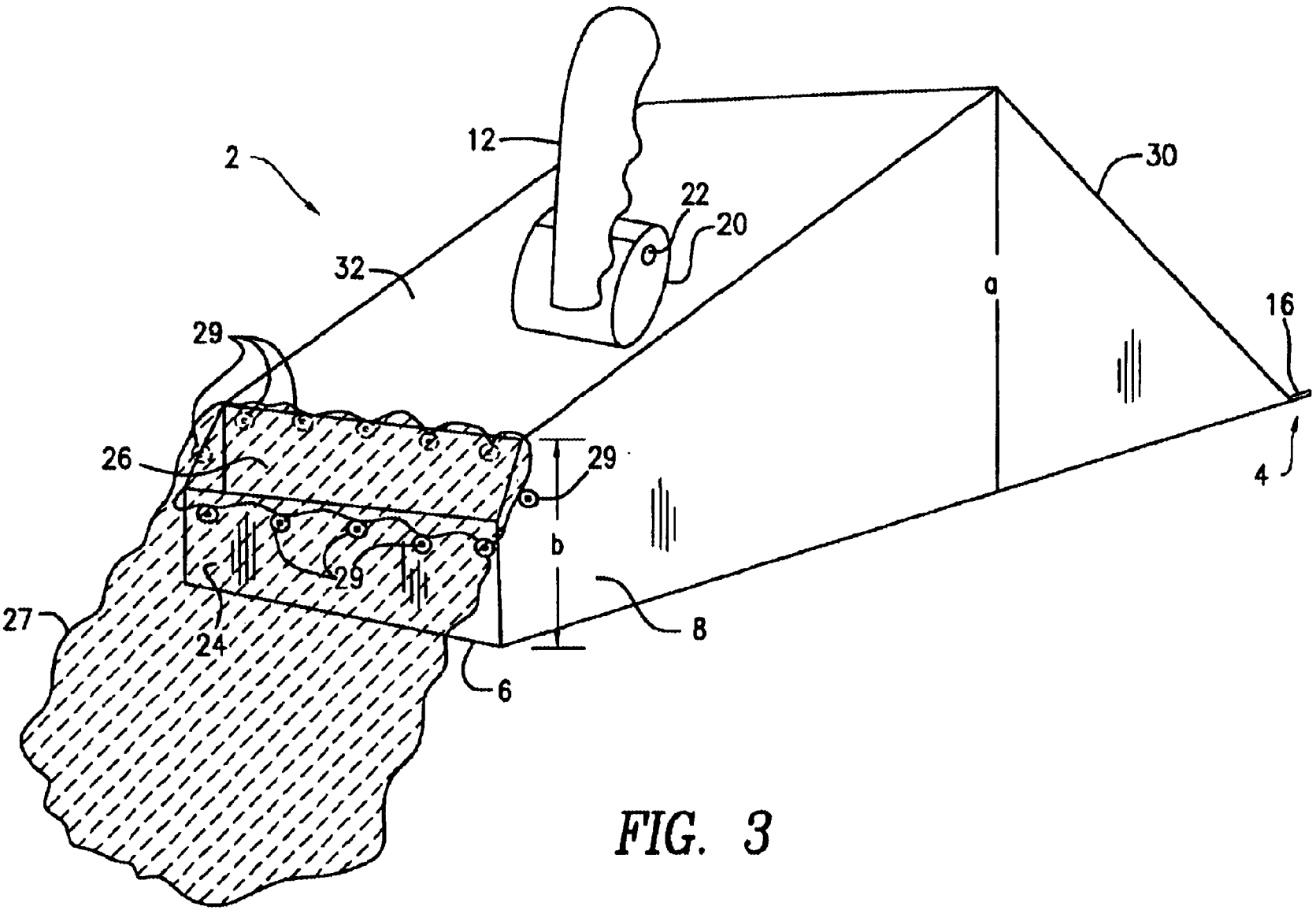
FIG. 3 is a rear perspective view of a preferred dust pan of the present invention showing collection bag emplacement.

Referring to FIGS. 1–3, there is shown a preferred embodiment of a dust pan 2 of the present invention. The dust pan 2 has a front edge 4. In the preferred embodiment of FIGS. 1–3, the dust pan 2 is provided with a stiffener or break 16 along the front edge of the bottom panel. The inclusion of a stiffener 16 is not critical to the present invention, and a plain flat edge will suffice. The stiffener 16 provides improved stiffness to the edge.

The dust pan 2 also comprises two sides, 8 and 10, that may extend from the front edge 4 of the bottom panel to back panel 24. The top edges of the two sides 8 and 10 slope downwardly from front to rear, the sides 8 and 10 having a front edge a and a back edge b such that length a is greater than length b, as seen in FIG. 3. In preferred embodiments, a is at least about 10% greater than b, preferably at least about 25% greater, more preferably at least about 35% and most preferably at least about 40%. In all events, a is sufficiently greater than b such that nesting of the dust pan is facilitated. At the bottom of back panel 24 is an edge 6. Front edge 4 has a length x and back edge 6 has a length y, as shown in FIG. 1. It is critical to the present invention that length x be greater than length y, typically where x is at least about 25% greater than y. In preferred embodiments, x is at least about 30% greater than y, more preferred is where x is at least about 35% greater than y, and most preferred is where x is at least about 40% greater than y. For example, where x is 18 inches, y could range from about 13.5 inches to about 10.8 inches.

Above the back panel is a rear debris outlet 26 that is preferably covered by back hinged panel 18. The back hinged panel 18 is hinged along the top edge 28 of top panel 32. The inclusion of back hinged panel 18 is not critical to the present invention and may be omitted. However, in a preferred embodiment, to further prevent any debris from being swept directly through rear debris outlet 26, the hinged back panel 18 is provided such that it closes off rear debris outlet 26 while the dust pan 2 is in the horizontal position, but readily opens when the dust pan 2 is tilted backwards for emptying operation.

The top panel 32 is provided between the two sides 8 and 10 and extends about one-half to two-thirds of the way down from the rear edge 28 towards the front edge 4. The amount that top panel 32 extends is not particularly critical to the present invention, as long as there is provided a sufficient debris inlet 30 in the front of the dust pan 2 so that debris may be swept into the interior of the dust pan 2. The front edge of the top panel 32 may optionally be provided with a stiffener 14, as shown in FIGS. 1 and 2.

On top of top panel 32 there is provided a handle housing 20 to which is attached a handle 12. In a preferred embodiment, the handle is attached via a pin 22 to housing 20. In yet another preferred embodiment the handle 12 may pivot from a substantially horizontal position as shown in FIG. 2, to a substantially vertical position as shown in FIGS. 1 and 3. In this embodiment, it is also contemplated by the present invention that an extension attachment (not shown) may be provided that may attach to the handle in any means known to those skilled in the art. In this manner, with the extension attached to the dust pan, the dust pan may be used from a standing position.

It is further contemplated by the present invention that provision is made for the attachment of a collection bag 27 to be attached to the dust pan to cover the rear debris outlet 26, as shown in FIG. 3. The collection bag 27 may be attached via any means known to those of ordinary skill in the art. FIG. 3 shows a collection bag attached by snaps 29, however, attachment by grommets, retaining bar, or a device such as a twist lock feature is also contemplated as part of the invention.

The dust pan of the present invention provides an improved method of cleaning up debris from a flat surface, with substantially less spillage of the debris back onto the flat surface when the dust pan is emptied. The debris is swept into the front debris inlet of the dust pan with any suitable sweeping means, such as a broom or a whisk broom. The dust pan is then lifted, preferably slightly tilted backwards to prevent spillage out of the front debris inlet. Then the rear debris outlet is placed over a suitable waste receptacle and the debris falls out of the rear debris outlet. Alternatively, the dust pan may be provided with a collection bag attached such that debris enters the collection bag when the dust pan is tilted back.

Advantageously, the dust pan of the present invention is especially useful for cleaning relatively large surfaces such as floors and walkways. The dust pans of the present invention can have relatively large front debris inlets, such as on the order of 3 or 4 feet, or even larger, and still provide a small enough debris outlet in the rear of the dust pan, such that there is substantially no spillage of the debris when emptying the dust pan into the waste receptacle. This enables the user to clean larger areas with less spillage and in a quicker fashion.

Figure 4:
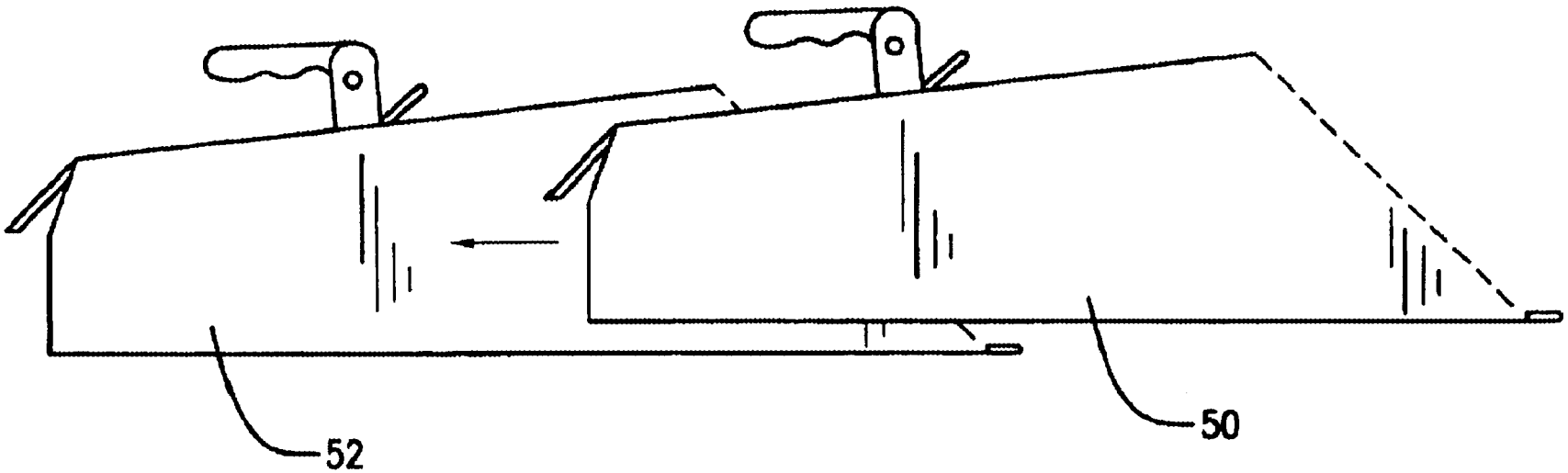
FIG. 4 shows nesting of one dust pan into a second dust pan.

FIG. 4 shows how a first dust pan 50 can be nested into a second dust pan 52 in accordance with the present invention.

Many variations of the present invention will suggest themselves to those skilled in the art in light of the above-detailed description. All such obvious modifications are within the full intended scope of the appended claims.

All of the above-referenced patents are hereby incorporated by reference.

What is claimed is:

1. A dust pan comprising the following components:

(a) a substantially flat bottom panel having a front edge of length x, a back edge of length y, a left side edge and a right side edge;

(b) a left side panel connected to the left side edge of the flat bottom panel and having a front edge of height a, a back edge of height b, and a top edge;

(c) a right side panel connected to the right side edge of the flat bottom panel and having a front edge of height a, a back edge of height b, and a top edge, (d) a substantially rectangular back panel attached to and extending from the back edge of the bottom panel and attached to the back edges of the left and right side panels;

(e) a substantially flat top panel attached to the top edges of the left and right side panels; and wherein a is greater than b, x is greater than y, the top edges of said left and right side panels are substantially straight and downwardly taper from the front to the back of said dust pan;

the back panel has a height less than the height of the back edges of said left and right side panels whereby a rear debris outlet is defined between an upper edge of said back panel and a lower surface of said top panel through which debris collected by the dust pan may be emptied; and said top panel has a length less than the length of said left and right side panels to thereby define a front debris inlet in said front of said dust pan.

2. A dust pan as defined in claim 1 wherein said top panel further comprises a handle attached to the top surface of the top panel.

3. A dust pan as defined in claim 2 wherein said handle is attached in hinged relation to said top surface of the top panel.

4. A dust pan as defined in claim 2 further comprising a handle extension means that is adapted to attach to said handle.

5. A dust pan as defined in claim 1 further comprising a back cover panel hingeably attached to the back edge of the top panel for substantially covering said rear debris outlet.

6. A dust pan as defined in claim 1 wherein x is at least about 25% greater than y.

7. A dust pan as defined in claim 6 wherein x is at least about 40% greater than y.

8. A dust pan as defined in claim 1 wherein a is at least about 10% greater than b.

9. A dust pan as defined in claim 8 wherein a is at least about 25% greater than b.

10. A dust pan as defined in claim 1 wherein x is about 18 inches, and y ranges from about 13.5 inches to about 10.8 inches.

11. A dust pan as defined in claim 1 wherein said front edge of said bottom panel is provided with a stiffener.

12. A dust pan as defined in claim 1 wherein the front edge of said top panel is provided with a stiffener.

13. A dust pan as defined in claim 1 wherein said back panel, side panels and top panel comprise a means for attaching a collection bag over said rear debris outlet.

14. A dust pan as defined in claim 1 wherein said rear debris outlet is substantially rectangular.

15. A dust pan as defined in claim 1 wherein the height of said side panel is approximately one-half of the height of the back edges of the left side panel and right side panel.

16. A dust pan as defined in claim 1 wherein the length of said top panel is approximately one-half of the length of the left side panel and right side panel.

17. A method for picking up and disposing of debris on a flat surface comprising sweeping said debris from said flat surface into the front debris inlet of the dust pan as defined in claim 1, and emptying said debris out of the rear debris outlet of said dust pan into a suitable waste receptacle.

18. A method as defined in claim 17 wherein said flat surface comprises a floor of a house.

19. A method as defined in claim 17 wherein said flat surface comprises a walkway.

* * * * *